US005862951A

United States Patent [19]

Gruenbacher et al.

[11] Patent Number: 5,862,951

[45] Date of Patent: Jan. 26, 1999

[54] REPLACEMENT FLUID CARTRIDGE FOR A POSITIVE DISPLACEMENT PUMP AND METHOD OF MAKING THE CARTRIDGE

[75] Inventors: Dana P. Gruenbacher, Fairfield; Gary E. McKibben, Middletown; Dale E. Barker, Hamilton, all of Ohio

[73] Assignee: The Procter & Gamble Company, Cincinnati, Ohio

[21] Appl. No.: 790,130

[22] Filed: Jan. 29, 1997

[51] Int. Cl.[6] ..... B67D 5/60

[52] U.S. Cl. ..... 222/145.1

[58] Field of Search ..... 222/325, 145.1, 222/137, 326, 327

[56] References Cited

U.S. PATENT DOCUMENTS

| | | | |
|---|---|---|---|
| 2,616,422 | 11/1952 | Jones | 222/95 X |
| 3,166,221 | 1/1965 | Nielsen | 222/137 |
| 3,304,977 | 2/1967 | Hammons | 150/1 |
| 3,323,682 | 6/1967 | Creighton, Jr. et al. | 222/94 |
| 3,561,644 | 2/1971 | Words et al. | 222/95 |
| 4,147,279 | 4/1979 | Matsui | 222/95 |
| 4,322,018 | 3/1982 | Rutter | 222/83 |
| 4,362,255 | 12/1982 | Bond | 222/107 |
| 4,378,069 | 3/1983 | Franco | 206/620 |
| 4,484,351 | 11/1984 | de Leeuwe et al. | 383/9 |
| 4,732,299 | 3/1988 | Hoyt | 222/94 |
| 4,801,046 | 1/1989 | Miczka | 222/95 |
| 4,842,165 | 6/1989 | Van Coney | 222/95 |
| 4,880,125 | 11/1989 | LeBeau | 215/11.3 |
| 4,972,969 | 11/1990 | Randklev | 222/1 |
| 4,989,758 | 2/1991 | Keller | 222/137 |
| 5,020,694 | 6/1991 | Pettentgill | 222/137 |
| 5,036,963 | 8/1991 | Pettengill et al. | 222/145 |
| 5,076,471 | 12/1991 | Coleman | 222/105 |
| 5,092,496 | 3/1992 | Gayle et al. | 222/319 X |
| 5,226,563 | 7/1993 | Coggiola | 222/95 |
| 5,271,528 | 12/1993 | Chien | 222/63 |
| 5,295,615 | 3/1994 | Gentile | 222/327 |
| 5,305,920 | 4/1994 | Reiboldt et al. | 222/95 |
| 5,305,921 | 4/1994 | Kock et al. | 222/95 |
| 5,332,124 | 7/1994 | Cancro et al. | 222/137 |
| 5,335,827 | 8/1994 | Gentile | 222/137 |
| 5,348,392 | 9/1994 | Bouquet et al. | 366/162 |
| 5,454,486 | 10/1995 | Mack et al. | 222/95 |
| 5,667,102 | 9/1997 | Keller | 222/95 |
| 5,699,935 | 12/1997 | Stahey | 222/137 |

FOREIGN PATENT DOCUMENTS

| | | | |
|---|---|---|---|
| 2294927 | 12/1974 | France | 222/95 |
| 461207 | 1/1951 | Italy | 222/326 |
| 136996 | 2/1930 | Switzerland | 222/326 |
| 386298 | 4/1909 | United Kingdom . | |
| 1103917 | 2/1968 | United Kingdom . | |

OTHER PUBLICATIONS

Article from Research Disclosure, Jun., 1995, p. 375.

*Primary Examiner*—Philippe Derakshani
*Attorney, Agent, or Firm*—Ronald W. Kock; Jack L. Oney, Jr.

[57] ABSTRACT

A replacement fluid cartridge for a dispenser has three parts: an injection molded nozzle, a thermoformed reservoir portion, and a cover sheet. The nozzle has a substantially flat top portion, an outer portion adjacent to the flat top portion, an outermost end, and a plurality of orifices extending through the nozzle. The second part is a piece of flexible film having a plurality of depressions surrounded by a flange. The flange is continuous and in a plane except at a nozzle-fitting portion. The nozzle-fitting portion is shaped to wrap around the outer portion of the nozzle where it is bonded to the nozzle in a fluid-tight manner. The flat top portion of the nozzle resides substantially within the plane of the flange. Each of the plurality of depressions has an inside, a continuous sidewall, and a closed bottom. The third part is a substantially flat cover sheet bonded to the flange and to the flat top portion of the nozzle such that the plurality of depressions are sealed closed by the cover sheet. Each of the plurality of orifices in the nozzle provide exclusive fluid communication from the outermost end of the nozzle to one inside of each of the plurality of depressions.

20 Claims, 4 Drawing Sheets

REPLACEMENT FLUID CARTRIDGE FOR A POSITIVE DISPLACEMENT PUMP AND METHOD OF MAKING THE CARTRIDGE

FIELD OF THE INVENTION

The present invention relates to replacement fluid cartridges for positive displacement, co-dispensing pumps wherein a volume of high viscosity fluid dispensed from each fluid reservoir is a function of reservoir displacement when the fluid cartridge is pressed against rigid posts. Even more particularly, the present invention relates to such fluid cartridges wherein the fluid reservoirs are flexible bags.

BACKGROUND OF THE INVENTION

Dispensers of high viscosity fluids may require significant force input from the user in order to initiate dispensing. Pushing downward with the palm of one's hand has been found to be an ergonomically efficient way for a user to develop sufficient force to dispense high viscosity fluids, such as toothpaste. Positive displacement pumps which utilize this approach have become available recently. An example is the MENTADENT™ toothpaste co-dispenser, a Trademark of Chesebrough-Pond's USA Co. of Greenwich, Conn.; which is disclosed in U.S. Pat. Nos. 5,295,615, and 5,335,827 to Gentile. The Mentadent co-dispenser has an upper portion containing two cylinders, each filled with different components of a toothpaste. At the end of each cylinder is a piston frictionally engaged in its cylinder to prevent leakage of toothpaste fluid from the cylinder. The upper portion is telescopingly connected to a bottom portion having two upright posts of equal length, which are spaced apart so as to align with the cylinders of the upper portion. When a user presses downward on the upper portion, the pistons are pressed against the two fixed posts. Such pressure causes the pistons to move upward into the cylinders and to drive toothpaste fluids from each cylinder through separate discharge orifices connected to the top of the cylinders. The amount of fluid dispensed from each cylinder is determined by the distance the upper portion is pushed downward and the diameters of the two cylinders.

The MENTADENT positive displacement toothpaste dispenser suffers from several deficiencies. First, the pistons provide considerable frictional resistance to movement in the cylinders when they are tight enough to prevent fluid leakage. High static friction and high fluid yield point require users to press hard to initiate dispensing. As a result, hard pressing to initiate flow must be immediately followed by lighter pressing to control displacement in order to avoid dispensing too much fluid. Such control is difficult for many users. Second, piston and cylinder arrangements require accurately molded or machined parts for adequate fit and reproducible operation. Such part accuracy is expensive.

A dispenser which avoids static friction and the need for accurate part requirements offers better function and lower manufacturing costs. In the caulking gun art, others have attempted to solve a similar friction problem by placing one or more flexible fluid-containing bags against a movable ram. For example, U.S. Pat. No. 3,323,682 to Creighton, Jr., et al. shows a ram pressed against the closed end of two side-by-side bags. The ram crushes the bags and fluid is dispensed from the opposite end of the bags. That is, each bag wrinkles axially as it shortens in length. Thin bags can be crushed nearly flat. However, even bag crushing may provide frictional resistance to dispensing because as the bag is crushed, the wrinkles typically slide along the cylinder wall. Also, any cocking of the ram relative to the cylinder may cause the bag wrinkles to jam between the ram and the cylinder wall.

Another type of toothpaste dispenser is the Crest Neat Squeeze dispenser, a trademark of The Procter & Gamble Company of Cincinnati, Ohio; which is disclosed in U.S. Pat. No. 4,842,165 to Van Coney. A squeezebottle has a fluid-containing bag housed inside the squeezebottle along with one-way air and fluid valving. Together these elements enable air pressure to be developed inside the squeezebottle and outside the bag which causes the bag to invert and thereby push out the toothpaste from the bag. An inverting bag has minimal friction resistance because the bag wall behaves like a rolling diaphragm. That is, the fold at the inverting point progressively moves from the closed end of the bag toward the discharge end. Such a dispenser can also be designed to discharge virtually all of its contents if the closed end of the bag matches the shape of the inside of the discharge end of the dispenser.

The Crest Neat Squeeze dispenser is a single use dispenser. When empty, the entire dispenser is discarded. Squeezebottles with bags and valving are more expensive than conventional toothpaste tubes. Thus, there is value in reusing the squeezebottle with its valving and in replacing fluid-containing bags in order to reduce the average package cost per unit of fluid delivered. Replacement bags are difficult to manage with such a dispenser, however, because the dispenser utilizes trapped air for dispensing. Reestablishing an air-tight seal after bag replacement is a problem because every user cannot be depended upon to provide adequate sealing. For example, when an expensive threaded engagement between rigid components is provided to generate a seal, users do not torque the components to the same degree.

U.S. Pat. No. 5,305,920 to Reiboldt et al. shows a Crest Neat Squeeze dispenser having a replacement cartridge with threaded components at the base of the dispenser. U.S. Pat. 5,454,486 to Mack et al. shows a similar dispenser having threaded components at the top of the dispenser. In both references not only is there an air sealing issue, but also there is a hygiene issue associated with toothpaste. Toothpaste is known for unsanitary-looking residue buildup on nozzles of tubes. The shape of the Crest Neat Squeeze nozzle is designed to minimize such buildup, but users still prefer a new nozzle with each new container of toothpaste. Replacing the nozzle with the bag results in the discharge valve also being replaced.

Therefore, what is missing in the prior art is a dispenser which utilizes the low friction of an inverting bag, and which has a replacement bag & nozzle that avoids both a discharge valve being discarded with each nozzle and unreliable user-generated air-tight sealing.

Dispensing multiple fluid components in accurate proportions is also an important need. Such fluid components typically have to be kept apart until the time of dispensing to prevent premature reaction between them. Vacuum type pump dispensers and dual compartment tubes are readily available. However, differences in fluid rheology cause one fluid to flow differently than the other when such dispensers are actuated. As a result, proportions dispensed are often inaccurate. One fluid reservoir may even run out of fluid before the other. Positive displacement pumps for simultaneous dispensing of multiple fluids in accurate proportions are now available, such as the MENTADENT piston and cylinder dispenser, whose deficiencies are discussed hereinbefore.

It is an object of the present invention to provide replaceable fluid cartridges having inverting bag reservoirs for high viscosity fluids, which operate in positive displacement co-dispensers such that there is the least possible pressing force required of a user to co-dispense fluids.

It is another object of the present invention to provide an inexpensive fluid cartridge, having a nozzle with separate orifices for each fluid and a nozzle closure, which can be made by an economic process from only three parts.

SUMMARY OF THE INVENTION

In one aspect of the present invention, a replacement fluid cartridge for a dispenser comprises three parts: an injection molded nozzle, a thermoformed reservoir portion, and a cover sheet. The dispenser has an upper portion and a lower portion adapted to simultaneously dispense a plurality of fluids from the cartridge through a common nozzle when the upper and lower portions are pressed together. The nozzle has a substantially flat top portion, an outer portion adjacent to the flat top portion, an outermost end, and a plurality of orifices extending through the nozzle. The second part is a piece of flexible film having a plurality of depressions surrounded by a flange. The flange is continuous and in a plane except at a nozzle-fitting portion whereat the nozzle-fitting portion is shaped to wrap around the outer portion of the nozzle. The nozzle-fitting portion is bonded to the outer portion of the nozzle in a fluid-tight manner and the flat top portion of the nozzle resides substantially within the plane of the flange. Each of the plurality of depressions has an inside, a continuous sidewall, and a closed bottom. The third part is a substantially flat cover sheet bonded to the flange and to the flat top portion of the nozzle such that the plurality of depressions are sealed closed by the cover sheet. Each of the plurality of orifices in the nozzle provide exclusive fluid communication from the outermost end of the nozzle to one inside of each of the plurality of depressions.

Each of the plurality of depressions preferably has a common depth which is greater than a maximum diametral dimension of any one depression measured at the flange. The sidewall of each of the plurality of depressions is preferably thin enough that a fluid placed in each depression may be dispensed through the plurality of orifices by simultaneously deforming each of the plurality of depressions in a direction substantially perpendicular to the flange. The continuous sidewall also preferably has a thickness at the flange greater than a thickness at the closed bottom so that each of the plurality of depressions may be readily inverted.

There is preferably a predetermined discharge volume ratio for each of the plurality of depressions. The volume ratio is a function of the maximum diametral dimension of each of the plurality of depressions. The plurality of depressions each have a common inner dimension such that the volume ratio is 1:1.

The nozzle preferably has an openable and reclosable closure at the outermost end to close the plurality of orifices so that the cartridge may be handled for removal and replacement from the dispenser without inadvertent fluid discharge from the plurality of orifices. The closure is preferably a snap-on cap hinged from the nozzle such that the closure remains with the nozzle when opened to prevent loss of the closure.

In another aspect of the present invention, a method of making a replacement fluid cartridge for a dispenser involves the making and assembly of three parts. The method of making the cartridge comprises the steps of thermoforming a plurality of depressions and a nozzle-fitting portion in a piece of flexible film. The plurality of depressions and the nozzle-fitting portion are surrounded by a flange, which is continuous and in a plane. Each of the plurality of depressions has an inside, a continuous sidewall, and a closed bottom. Another step involves trimming the nozzle-fitting portion such that the nozzle-fitting portion has an open end. Still another step includes injection molding a nozzle having an outermost end, a substantially flat top portion, and an outer portion adjacent to the flat top portion. The nozzle also has a plurality of orifices extending therethrough from the outermost end. Yet another step comprises sealing the nozzle into the nozzle-fitting portion such that the flat top portion of the nozzle resides substantially within the plane of the flange, and wherein the outermost end of the nozzle occupies the open end of the nozzle-fitting portion.

A step of filling each of the plurality of depressions with a fluid may occur before or after the nozzle is sealed to the thermoformed part. A final step includes bonding a substantially flat cover sheet to the flange and to the flat top portion of the nozzle such that the plurality of depressions are sealed closed by the cover sheet. Each of the plurality of orifices in the nozzle provide exclusive fluid communication from the outermost end of the nozzle to one inside of each of the plurality of depressions after the flat piece is sealed in place. However, each of the plurality of depressions is preferably filled through an opening other than an orifice in the nozzle.

The method may further comprise the step of molding an openable and reclosable snap-on cap hinged to the nozzle to close the plurality of orifices so that the cartridge may be handled for removal and replacement from the dispenser without inadvertent fluid discharge from the plurality of orifices. The method may still further comprise the step of cutting the replacement fluid cartridge from a web having multiple replacement fluid cartridges formed and filled and sealed therein.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 8:
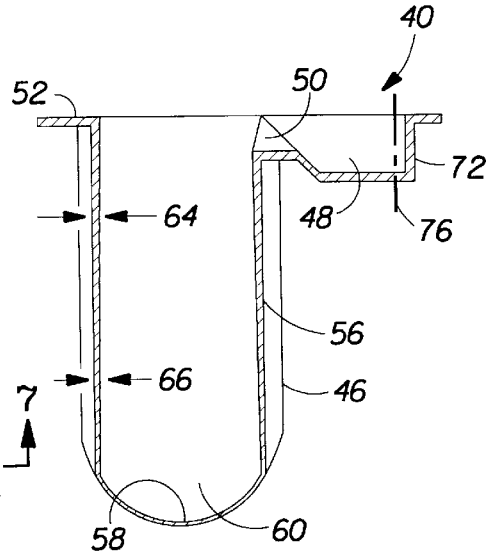
FIG. 8 is a sectioned left side elevation view thereof, taken along section line 8—8 of FIG. 6, showing tapered walls of one fluid reservoir and a trimming center line, which indicates where the nozzle-fitting recess has its outer end opened for placement of the nozzle therein.
Figure 10:
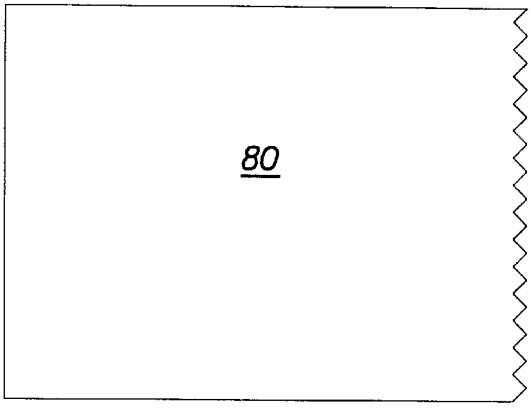
FIG. 10 is a top plan view of a web of cover sheet of the present invention about to be placed atop the filled thermoformed web, showing the width of the cover sheet film being substantially the same as the width of the trimmed thermoformed web.
Figure 12:
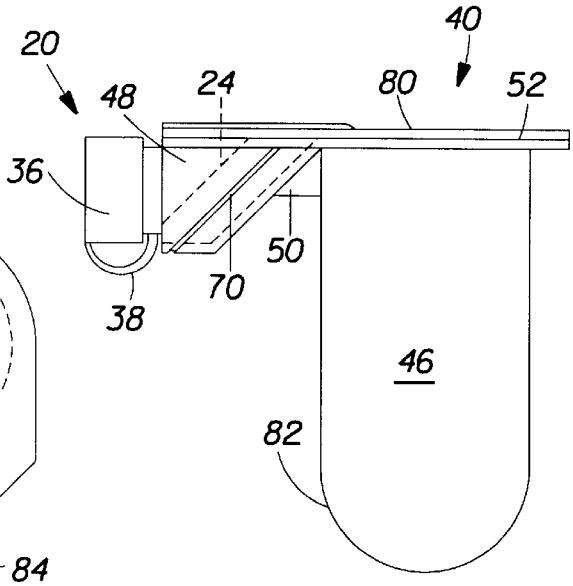
FIG. 12 is a right side elevation view thereof, showing the assembly of the nozzle, thermoformed portion, and the cover sheet sealed together with a closure hinged from the nozzle and attached to the outermost end of the nozzle to close the two orifices.
Figure 13:
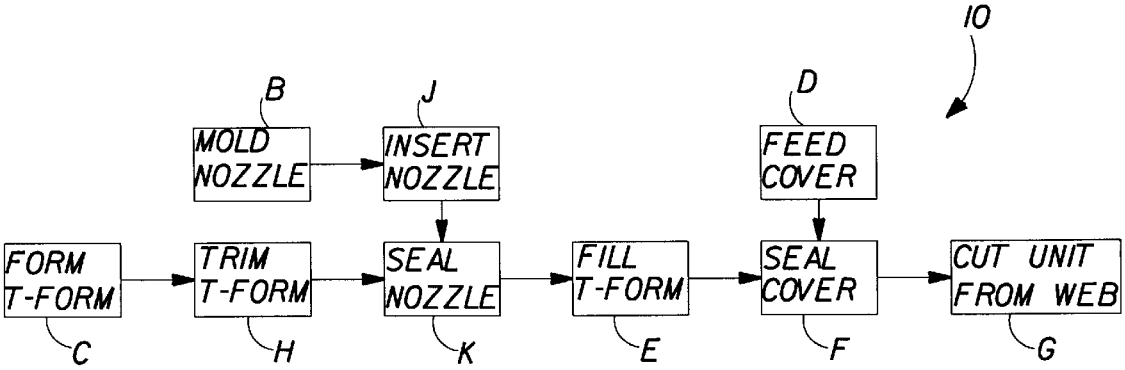
FIG. 13 is a flow diagram of a method of the present invention, showing the steps of forming the thermoformed portion, trimming the thermoformed web, molding the nozzle, inserting the nozzle into the nozzle-fitting portion of the thermoformed web, sealing the nozzle to the nozzle-fitting portion, filling the thermoformed fluid reservoirs, feeding the cover sheet web onto the flange of the thermoformed web, sealing the cover sheet web around the filled reservoirs and over the flat top portion of the nozzle, and cutting the cartridge from the combined webs.

Referring now to the drawings, and more particularly to FIG. 13, there is shown a preferred embodiment of the present invention, which provides a method of making a replacement fluid cartridge, and is generally indicated as 10. Method 10, as described in the Brief Description of Drawings, includes nine steps to form and combine three structural components and one or two fluids. A "mold nozzle" step B produces a part, generally indicated as 20 in FIGS. 1–5. A "form T-form" step C produces a continuous web of repeating parts, generally indicated as 40 in FIGS. 6–8. A "feed cover" step D produces a continuous cover sheet web 80, as shown in FIGS. 10–12.

Figure 1:
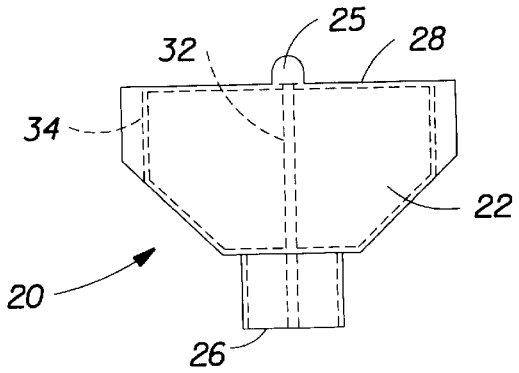
FIG. 1 is a top plan view of a nozzle of the replacement fluid cartridge of the present invention, disclosing a flat top portion.
Figure 4:
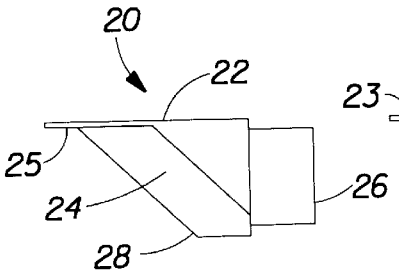
FIG. 4 is a left side elevation view thereof, showing a profile of the nozzle.
Figure 2:
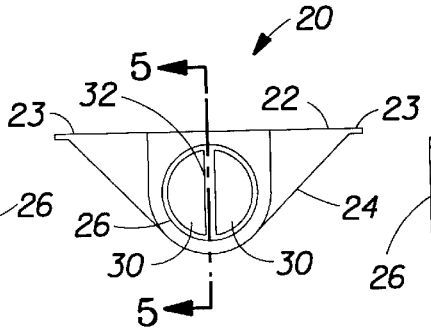
FIG. 2 is a front elevation view thereof, showing a cylindrical outermost end of the nozzle having a vertical wall dividing the discharge into two orifices.
Figure 5:
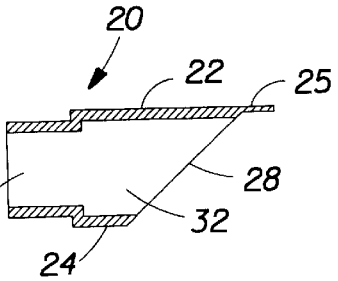
FIG. 5 is a sectioned right side elevation view thereof, taken along section line 5—5 of FIG. 2, showing the continuous vertical wall separating the two orifices.
Figure 3:
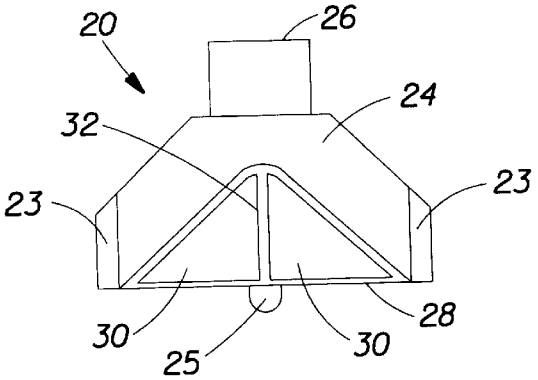
FIG. 3 is a bottom plan view thereof, disclosing the vertical wall extending to the rear of the nozzle to maintain divided the two orifices extending through the nozzle.

Nozzle 20 is preferably made of rigid plastic and even more preferably is injection molded from polypropylene. Nozzle 20 has a substantially flat top portion 22; an outer portion 24 adjacent to flat top portion 22; an outermost end 26, which is the discharge end of the nozzle; and a rear end 28 opposite outermost end 26. Extending from outermost end 26 to rear end 28 is a plurality of orifices 30 through nozzle 20. There are preferably two side-by-side orifices 30, which are separated by a dividing wall 32, best seen in FIGS. 1 and 5. FIG. 1 shows continuous wall 34 of outer portion 24 intersecting flat top portion 22, as represented by dotted lines. Although flat top portion 22 is shown as a continuous surface, the upper edges of walls 32 and 34 could serve as the flat top portion for sealing to a cover sheet, such that orifices 30 would remain separated and fully enclosed.

Figure 9:
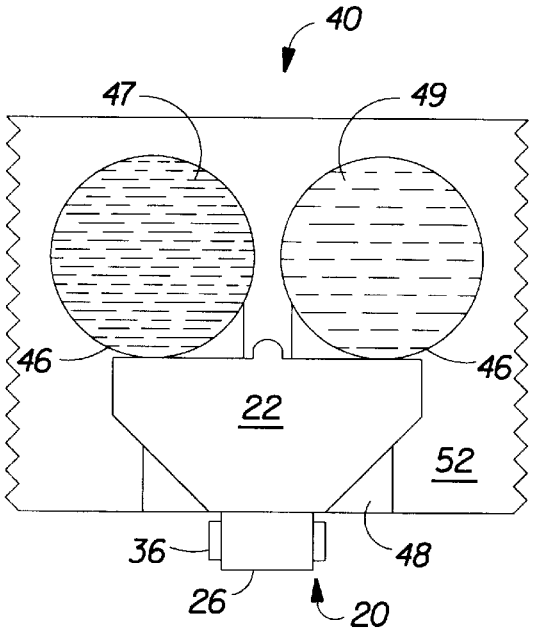
FIG. 9 is a top plan view of the thermoformed web of film of FIG. 6, showing the trimmed portion removed, the nozzle sealed in the nozzle-fitting recess, and the fluid reservoirs filled, each with a different fluid.
Figure 11:
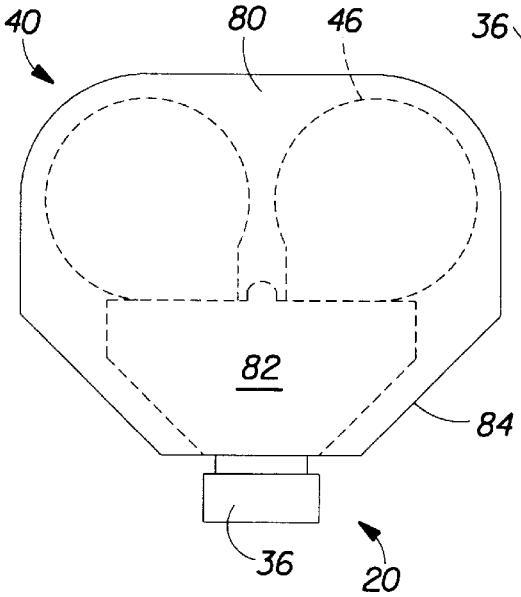
FIG. 11 is a top plan view of the replacement fluid cartridge of the present invention, showing the cover sealed to the flat top portion of the nozzle and to the flange surrounding the thermoformed fluid reservoirs, the flange and cover sheet being cut to separate the cartridge from the combined webs.

Although not shown in FIGS. 1–5, nozzle 20 may have an integrally molded snap-on closure 36 hinged by a hinge 38 near outermost end 26, as shown in FIGS. 9, 11, and 12. Closure 36 is openable and reclosable and is intended to completely close orifices 30 in a liquid and air-tight manner. Closure 36 could alternatively be a threaded closure or a plug type closure or other style closure typically used with rigid fitments.

Some fluids used with positive displacement dispensers are susceptible to phase separation, oxidation, or other undesirable changes in the presence of air. Therefore, it is often important to purge air from the headspace of a filled reservoir before a fluid cartridge is sealed for shipping and storage. Closure 36 may be open or partially open when a "fill T-form" step E and a "seal cover" step F are completed. Additional steps, not shown, are deforming fluid reservoirs to raise fluid levels and thereby purge air from reservoir headspaces through open orifices 30 before closure 36 is closed, and then completely closing closure 36. Such steps would occur between "seal cover" step F and a "cut unit from web" step G.

Figure 6:
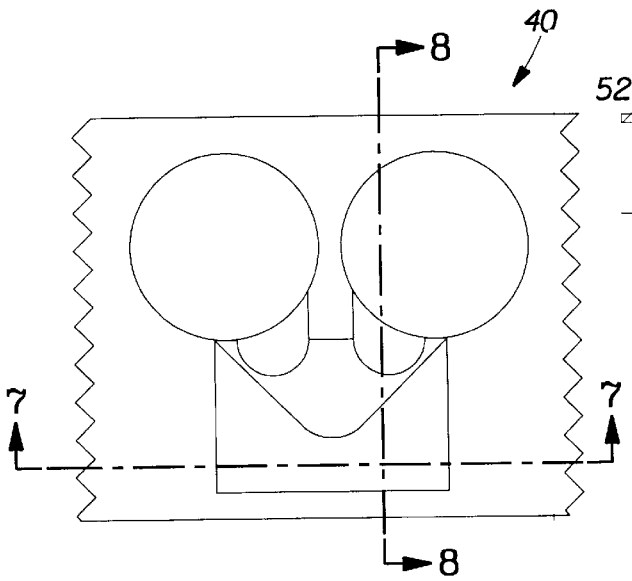
FIG. 6 is a top plan view of a web of film of the present invention, having thermoformed therein two fluid reservoirs and a nozzle-fitting recess, repeat patterns thereof assumed adjacent thereto, the reservoirs and nozzle-fitting recess being surrounded by a planar flange.
Figure 7:
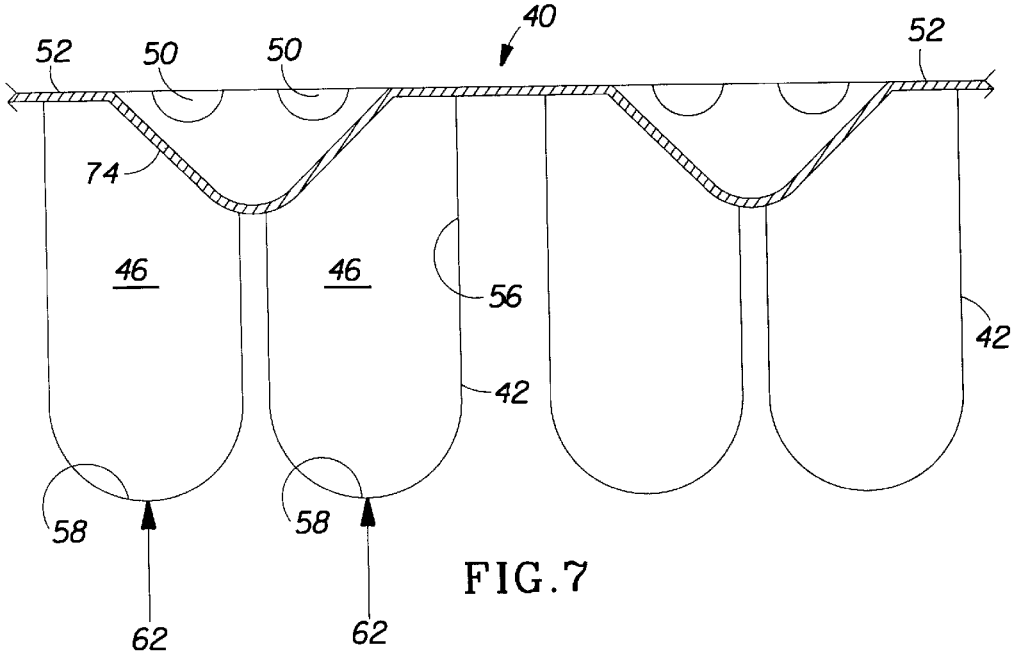
FIG. 7 is a sectioned front elevation view thereof, taken along section line 7—7 of FIG. 6, showing the depth of the fluid reservoirs and two passages connecting each fluid reservoir to the nozzle-fitting recess.

Continuous web of repeating parts 40 has repeat sets of thermoformed cavities 42, as shown in FIG. 7. As shown in FIG. 6, each set 42 includes a plurality of depressions 46, a nozzle-fitting recess 48, and a plurality of passages 50 providing fluid communication between each depression 46 and nozzle-fitting recess 48, but with no fluid communication from one depression to another. After thermoforming occurs, a continuous flange 52 results, surrounding all depressions and recesses from one repeat set to another. Flange 52 is preferably in a single plane 54. In a most preferred embodiment, intended to be used with a positive displacement co-dispensing pump, there are only two depressions 46 and two passages 50 in each repeat pattern. Depressions 46 are fluid reservoirs for preferably two different incompatible fluids, first fluid 47 and second fluid 49, which must be maintained separated until dispensed. However, a common fluid could be used in both reservoirs with no adverse consequences. First Fluid 47 is preferably a baking soda toothpaste component and second fluid 49 is preferably a peroxide toothpaste component.

Further details concerning a positive displacement co-dispensing pump of the type for which the replacement fluid cartridge of present invention may be useful is found in copending application Ser. No. 08/588,488, entitled "INVERTING BAG CO-DISPENSER", filed on Jan. 18, 1996 now U.S. Pat. No. 5,699,935, which is assigned to the assignee of the present application, and which is hereby incorporated by reference. Disclosed is an upper portion with nozzle which houses a dual fluid-containing bag arrangement, having both bags supported within side-by-side annular tubes. Also disclosed is a lower portion into which the upper portion telescopes. The lower portion has two rigid upright posts which are aligned with the annular tubes and which press against the closed bottoms of the flexible bags. When the upper portion is pressed into the lower portion, the posts cause the bags to simultaneously invert and discharge their contents, as a function of how far the upper portion is telescoped into the lower portion.

Continuous web of repeating parts 40 is preferably made of a flexible film. Even more preferably, the flexible film is a laminate which provides barrier properties to any fluid housed within depressions 46, passages 50, and nozzle 20.

Depressions 46 may be cylindrical, as shown, or oval or have other convex curvature perimeters. Each depression 46 has continuous sidewall 56, a closed bottom 58, and an inside 60. The intent is that such depressions be capable of being collapsed in a direction 62 substantially perpendicular to flange 52, either by crushing or by inverting. Inverting is a most preferred mode of collapse because it provides the lowest dispensing force. For example, inverting forces have been measured in the range of 11 to 15 pounds from full to empty for MENTADENT tartar control toothpaste. This compares to dispensing forces of 17 to 20 pounds for a standard piston in cylinder MENTADENT dispenser.

For optimum inverting, depressions 46 have a thickness 64 near flange 52 which is greater than a thickness 66 near closed bottom 58 by a ratio of about 2 to 1. Depressions 46 are preferably the same depth, size, and shape so that a dispensing ratio is 1:1 and dispensing commences simultaneously from each fluid reservoir. However, the dispensing ratio may easily be modified by changing a maximum diametral dimension 68, as measured at flange 52 for each depression 46, assuming depression shape and depth are maintained constant. Alternatively, dispensing ratio may be modified by varying the shapes of the depressions as well as the maximum diametral dimensions.

Nozzle-fitting recess 48 is thermoformed to have the same shape as outer portion 24 of nozzle 20 so that the two components may be sealed together in a leak-tight fashion without wrinkles. Since nozzle 20 extends beyond the length of nozzle-fitting recess 48 and an end wall 72 of recess 48 blocks outermost end 26 of nozzle 20, when the parts are combined, end wall 72 must be removed from recess 48 to provide an open end 74. This is achieved preferably by "trim T-form" step H. Method 10 is preferably an indexing system. Therefore, step H may be a reciprocating die cutting operation in which a die progressively shears off the entire edge of continuous web 40 just inside recess 48, as show by trim centerline 76 in FIG. 8. The result is the open end 74 as shown in FIG. 7.

FIGS. 9 and 12 show an "insert nozzle" step J and a "seal nozzle" step K. FIG. 12 shows a continuous nozzle seal band 70 which is preferably made by a hot die. Outer portion 24 of nozzle 20 may have raised beads, which act as energy concentrators for ultrasonic sealing or conduction sealing.

Wherever wrinkles are allowed to occur, sealing in a leak-tight fashion is made more difficult. For this reason, flat top portion 22 is designed to be located substantially in the same plane 54 in which flange 52 resides, as shown in FIG. 12. This arrangement allows cover sheet 80 to be sealed to both flange 52 and flat top portion 22 with minimal wrinkling. Thin tabs 23 and 25 extend from flat top portion 22 to overlay flange 52 for the purpose of sealing the intersections of the nozzle and thermoform. That is, tabs 23 and 25 melt to fill in the intersection joints. Therefore, flat top portion 22 is slightly raised above flange 52.

FIG. 11 illustrates final step G. Cover sheet 80 is preferably a continuous web metered from a roll onto and aligned with trimmed continuous thermoformed web 40. Sealing is preferably accomplished by a hot bar conduction heating process, using controlled time, temperature and pressure of about 1–2 seconds, 350° F., and 40 psi. After cover sheet 80 is sealed to flange 52 and nozzle 20, and closure 36 is closed, repeat unit 42 may be punched out of continuous web 40 and continuous cover sheet web 80 by a die cutting operation to form replacement fluid cartridge 82 having outer shape 84.

In a particularly preferred embodiment of the present invention, continuous web 40 is a coextrusion or laminate of polypropylene (PP)/ethyl vinyl alcohol (EVOH)/polypropylene (PP). The laminate is about 0.023 inches thick, with the EVOH layer being about 0.003 inches thick. The EVOH layer is a barrier layer, protecting fluids 47 and 49 from oxidation and flavor loss. Cover sheet 80 is also preferably a barrier laminate. It may have a foil layer for barrier protection. Although a foil is not heat formable, it need not be since coversheet. 80 remains relatively flat. A foil layer is beneficial in that foil can be easily printed. Alternatively, a layer of PET may be the outermost layer. It too can be easily reverse printed. The advantage of thermoforming fluid reservoirs 46 instead of blow molding them is that barrier laminates are more easily used with a thermoforming process where the materials are softened but not melted.

Thermoformed depressions 46 are preferably 1.5 inches diameter and 3 inches deep with a flat or hemispherical closed bottom. The two depressions are preferably filled with about 5.2 fluid ounces of fluid. If a bottom shape is hemispherical, inverting the depression is improved but emptying its fluid is hindered. If a bottom shape is flat, emptying the fluid is improved, but inverting the depression is more difficult. Depressions 46 are made on a Hydrotrim Pressure Former, made by Hydro-Trim Corporation of W. Nyack, N.Y. The thermoformer has top and bottom radiant heaters, plug assist, and pressure or vacuum application to the heated film. For the PP/EVOH/PP laminate, the thermoforming conditions are heating to a range of from about 400° F. to about 450° F. for 42 seconds, followed by pressure forming with a plug assist for 15 seconds.

The taper of continuous sidewall 56 of each depression, as indicated by dimensions 64 and 66 is from about 0.023 inches to about 0.003 inches in three inches of depression depth. There is preferably a half degree of draft angle at the exterior of each depression to enable easy removal from a thermoforming die and for smooth inversion without wrinkling or stretching.

Getting inversion started is enhanced by centering the dispenser posts on the bottoms of depressions 46. Centering may be improved by thermoforming a dimple 88 in the center of the closed bottom 58 of each depression 46, as shown in FIG. 12. Dimple 88 preferably engages a mating centering shape in the center of the end of each post. When the post engages dimple 88, minimal lateral movement of depression 46 is permitted.

The nozzle-fitting portion 48 is typically thinned to about 0.013 inches thickness by thermoforming. Sealing nozzle 20 into nozzle-fitting portion 48 preferably occurs in about 3 seconds when a die heated to about 400° F. is applied to the underside of portion 48 with a pressure ranging from 40 to 8 PSI.

Cover sheet 80 is preferably a PP copolymer/aluminum foil/PET laminate, sealed with PP side down to the flat top portion of the PP nozzle and PP outer layer of the thermoform flange. This sealing is accomplished by a Sentinel Heat Sealer with heated plate at a temperature of 350° F., a seal pressure of 40 psi, and a 1–2 second contact time.

Providing a replacement fluid cartridge with a nozzle rather than reusing a pump nozzle cause cartridge 82 to be more expensive than if the nozzle remained with the pump. However, the nozzle as part of the cartridge avoids the messiness of connecting a replacement bag to a nozzle which already has fluid in it. Nozzle reuse is considered by consumers to be a serious hygiene problem.

The method of the present invention preferably is a continuous web process, using form/fill/seal equipment such as that made by Hassia, Bosch, or Multivac. However, individual repreat unit thermoforms could be made from a piece of flexible film, and they could be covered with pre-cut individual cover sheets, as an alternative method.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A replacement fluid cartridge for a positive displacement dispenser, said dispenser having an upper portion and a lower portion adapted to simultaneously dispense a plurality of fluids from said cartridge through a common nozzle when said upper and said lower portions are pressed together, said cartridge comprising:

a) a nozzle having a substantially flat top portion, an outer portion adjacent to said flat top portion, an outermost end, and a plurality of orifices extending through said nozzle;

b) a piece of flexible film having a plurality of depressions surrounded by a flange, said flange being continuous and in a plane except at a nozzle-fitting portion whereat said nozzle-fitting portion is shaped to wrap around said outer portion of said nozzle, said nozzle-fitting portion being bonded to said outer portion of said nozzle in a fluid-tight manner and such that said flat top portion of said nozzle resides substantially within said plane of said flange, each of said plurality of depressions having an inside, a continuous sidewall, and a closed bottom; and c) a substantially flat cover sheet bonded to said flange and to said flat top portion of said nozzle such that said plurality of depressions are sealed closed by said cover sheet, each of said plurality of orifices in said nozzle providing exclusive fluid communication from said outermost end to one inside of each of said plurality of depressions.

2. The replacement fluid cartridge of claim 1 wherein said sidewall of each of said plurality of depressions is thin enough that a fluid placed in each of said plurality of depressions may be dispensed through each of said plurality of orifices by simultaneously deforming each of said plurality of depressions in a direction substantially perpendicular to said flange.

3. The replacement fluid cartridge of claim 2 wherein said continuous sidewall has a thickness at said flange greater than a thickness at said closed bottom so that each of said plurality of depressions may be readily inverted.

4. The replacement fluid cartridge of claim 1 wherein there is a predetermined discharge volume ratio for each of said plurality of depressions as a function of a maximum diametral dimension of each of said plurality of depressions.

5. The replacement fluid cartridge of claim 4 wherein said plurality of depressions each have a common inner dimension such that said volume ratio is 1:1.

6. The replacement fluid cartridge of claim 1 wherein said nozzle has an openable and reclosable closure at said outermost end to close said plurality of orifices so that said cartridge may be handled for removal and replacement from said dispenser without inadvertent fluid discharge from said plurality of orifices.

7. The replacement fluid cartridge of claim 6 wherein said closure is a snap-on cap hinged from said nozzle such that said closure remains with said nozzle when opened to prevent loss of said closure.

8. The replacement fluid cartridge of claim 1 wherein each of said plurality of depressions has a common depth which is greater than a maximum diametral dimension of any one depression measured at said flange.

9. A replacement fluid cartridge for a positive displacement dispenser, said dispenser having an upper portion and a lower portion adapted to simultaneously dispense a plurality of fluids from said cartridge through a common nozzle when said upper and said lower portions are pressed together, said cartridge comprising:

a) a nozzle having a substantially flat top portion, an outer portion adjacent to said flat top portion, an outermost end, and a plurality of orifices extending through said nozzle;

b) a piece of flexible film having a plurality of depressions surrounded by a flange, said flange being continuous and in a plane except at a nozzle-fitting portion whereat said nozzle-fitting portion is shaped to wrap around said outer portion of said nozzle, said nozzle-fitting portion being bonded to said outer portion of said nozzle in a fluid-tight manner and such that said flat top portion of said nozzle resides substantially within said plane of said flange, each of said plurality of depressions having an inside, a continuous sidewall, and a closed bottom;

c) a fluid placed in each of said plurality of depressions;

d) a substantially flat cover sheet bonded to said flange and to said flat top portion of said nozzle such that said plurality of depressions are sealed closed by said cover sheet, each of said plurality of orifices in said nozzle providing exclusive fluid communication from said outermost end to one inside of each of said plurality of depressions; and e) an openable and reclosable closure connected to said nozzle to close said plurality of orifices so that said cartridge may be handled for removal and replacement from said dispenser without inadvertent fluid discharge from said plurality of orifices.

10. The replacement fluid cartridge of claim 9 wherein said sidewall of each of said plurality of depressions is thin enough that said fluid in each of said plurality of depressions may be dispensed through each of said plurality of orifices by deforming each of said plurality of depressions in a direction substantially perpendicular to said flange.

11. The replacement fluid cartridge of claim 10 wherein said continuous sidewall has a thickness at said flange greater than a thickness at said closed bottom so that each of said plurality of depressions may be readily inverted.

12. The replacement fluid cartridge of claim 9 wherein said closure is a snap-on cap hinged from said nozzle such that said closure remains with said nozzle when opened to prevent loss of said closure.

13. A method of making a replacement fluid cartridge for a positive displacement dispenser, said dispenser having upper and lower portions adapted to simultaneously dispense a plurality of fluids from said cartridge through a common nozzle when said upper and lower portions are pressed together, said method of making said cartridge comprising the steps of:

a) forming a plurality of depressions and a nozzle-fitting portion in a piece of flexible film, said plurality of depressions and said nozzle-fitting portion being surrounded by a flange, said flange being continuous and in a plane, each of said plurality of depressions having an inside, a continuous sidewall, and a closed bottom;

b) trimming said nozzle-fitting portion such that said nozzle-fitting portion has an open end;

c) injection molding a nozzle having an outermost end, a substantially flat top portion, and an outer portion adjacent to said flat top portion, said nozzle also having a plurality of orifices extending therethrough from said outermost end;

d) sealing said nozzle into said nozzle-fitting portion such that said flat top portion of said nozzle resides substantially within said plane of said flange, and wherein said outermost end of said nozzle occupies said open end of said nozzle-fitting portion;

e) filling each of said plurality of depressions with a fluid;

f) bonding a substantially flat cover sheet to said flange and to said flat top portion of said nozzle such that said plurality of depressions are sealed closed by said substantially flat cover sheet, each of said plurality of orifices in said nozzle providing exclusive fluid communication from said outermost end to one inside of each of said plurality of depressions.

14. The method of claim 13 wherein said sidewall of each of said plurality of depressions is thin enough that said fluid in each of said plurality of depressions may be dispensed through each of said plurality of orifices by simultaneously deforming each of said plurality of depressions in a direction substantially perpendicular to said flange.

15. The method of claim 14 wherein said continuous sidewall has a thickness at said flange greater than a thickness at said closed bottom so that each of said plurality of depressions may be readily inverted.

16. The method of claim 13 wherein there is a predetermined discharge volume ratio for each of said plurality of depressions as a function of a maximum diametral dimension of each of said plurality of depressions.

17. The method of claim 13 further comprising the step of molding an openable and reclosable snap-on cap hinged to said nozzle to close said plurality of orifices so that said cartridge may be handled for removal and replacement from said dispenser without inadvertent fluid discharge from said plurality of orifices.

18. The method of claim 13 wherein each of said plurality of depressions is filled through an opening other than an orifice in said nozzle.

19. The method of claim 13 wherein each of said plurality of depressions has a common depth which is greater than a maximum diametral dimension of any one depression measured at said flange.

20. The method of claim 13 further comprising the step of cutting said replacement fluid cartridge from a web having multiple replacement fluid cartridges formed and filled and sealed therein.

* * * * *